US010784580B2

(12) United States Patent
Lin

(10) Patent No.: US 10,784,580 B2
(45) Date of Patent: Sep. 22, 2020

(54) METAL-INTEFERENCE-RESISTING DIPOLE ANTENNA

(71) Applicants: INVENTEC (PUDONG) TECHNOLOGY CORPORATION, Shanghai (CN); INVENTEC CORPORATION, Taipei (TW)

(72) Inventor: Yuan Sheng Lin, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 33 days.

(21) Appl. No.: 16/210,897

(22) Filed: Dec. 5, 2018

(65) Prior Publication Data

US 2020/0168995 A1 May 28, 2020

(30) Foreign Application Priority Data

Nov. 27, 2018 (CN) ..... 2018 1 1425351

(51) Int. Cl.
*H01Q 9/04* (2006.01)
*H01Q 1/38* (2006.01)
*H01Q 19/13* (2006.01)

(52) U.S. Cl.
CPC ..... *H01Q 9/0414* (2013.01); *H01Q 1/38* (2013.01); *H01Q 9/0435* (2013.01); *H01Q 19/138* (2013.01)

(58) Field of Classification Search
CPC .... H01Q 9/0414; H01Q 9/285; H01Q 9/0407; H01Q 9/0421; H01Q 9/0428; H01Q 9/0435
See application file for complete search history.

(56) References Cited

U.S. PATENT DOCUMENTS 5,594,455 A * 1/1997 Hori ..... H01Q 9/0414 343/700 MS
5,986,606 A * 11/1999 Kossiavas ..... H01Q 9/0421 343/700 MS
2005/0062651 A1* 3/2005 Dai ..... H01Q 1/38 343/700 MS
2010/0141544 A1* 6/2010 Chao ..... H01Q 1/08 343/795

* cited by examiner

*Primary Examiner* — Daniel Munoz
(74) *Attorney, Agent, or Firm* — Maschoff Brennan

(57) ABSTRACT

A metal-interference-resisting dipole antenna comprises a first metal plane, a second metal plane and a cable; the cable comprises an inner conductor, an insulation layer and an outer conductor, and the inner conductor comprises a first inner connecting end electrically connected to the first metal plane, and a second inner connecting end adapted for receiving the first feed signal; the insulation layer partly covers the inner conductor, wherein the outer conductor is disposed at the outer of the insulation layer corresponding to the inner conductor, and the outer conductor is electrically insulated from the inner conductor; the outer conductor has a first outer connecting end and a second outer connecting end, and the first outer connecting end is electrically connected to the second metal plane, and the second outer connecting end is adapted for receiving the second feed signal.

7 Claims, 4 Drawing Sheets

METAL-INTEFERENCE-RESISTING DIPOLE ANTENNA

CROSS-REFERENCE TO RELATED APPLICATIONS

This non-provisional application claims priority under 35 U.S.C. § 119(a) on Patent Application No(s). 201811425351.1 filed in China on 27, Nov., 2018 the entire contents of which are hereby incorporated by reference.

BACKGROUND

1. Technical Field

The disclosure relates to a dipole antenna, more particularly to the metal-interference-resisting dipole antenna.

2. Related Art

Since the technology of the wireless communication is already grown completely, different antennas have been disposed in various electronic devices. Additionally, since the dipole antenna has the simple structure and is early to be applied, the dipole antenna has been widely used presently.

In general, the traditional dipole antenna is made by two coplanar metal planes and a cable connected between the two metal planes, so the area is larger than other components in the electronic device. Also, when there are metal properties closed to the dipole antenna, the operational efficiency of the dipole antenna will be obviously decreased. However, in order to meet the demand of the people for the electronic device with both of the variety functions and the quality appearance, in the present market, the configuration of the internal circuits in the electronic device is more and more complex, and there're more and more electronic devices configured with the metal housing. Hence, the configuration of the dipole antenna is limited by said above properties, and the problem thereof still needs to be improved.

As a result, it needs a dipole antenna with the function of metal interference resistance presently in order to improve said above problem.

SUMMARY

According to one or more embodiment of this disclosure, a metal-interference-resisting dipole antenna includes: a first metal plane, a second metal plane and a cable. The cable includes an inner conductor, an insulator and an outer conductor, wherein the inner conductor has a first inner connecting end and a second inner connecting end, the first inner connecting end is electrically connected to the first metal plane, the second inner connecting end is adapted for receiving a first feed signal, the inner conductor is partially covered by the insulator, the outer conductor is, corresponding to the inner conductor, disposed on an outer side of the insulator, and the outer conductor is electrically insulated from the inner conductor; and wherein the outer conductor has a first outer connecting end and a second outer connecting end, the first outer connecting end is electrically connected to the second metal plane, and the second outer connecting end is adapted for receiving a second feed signal.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
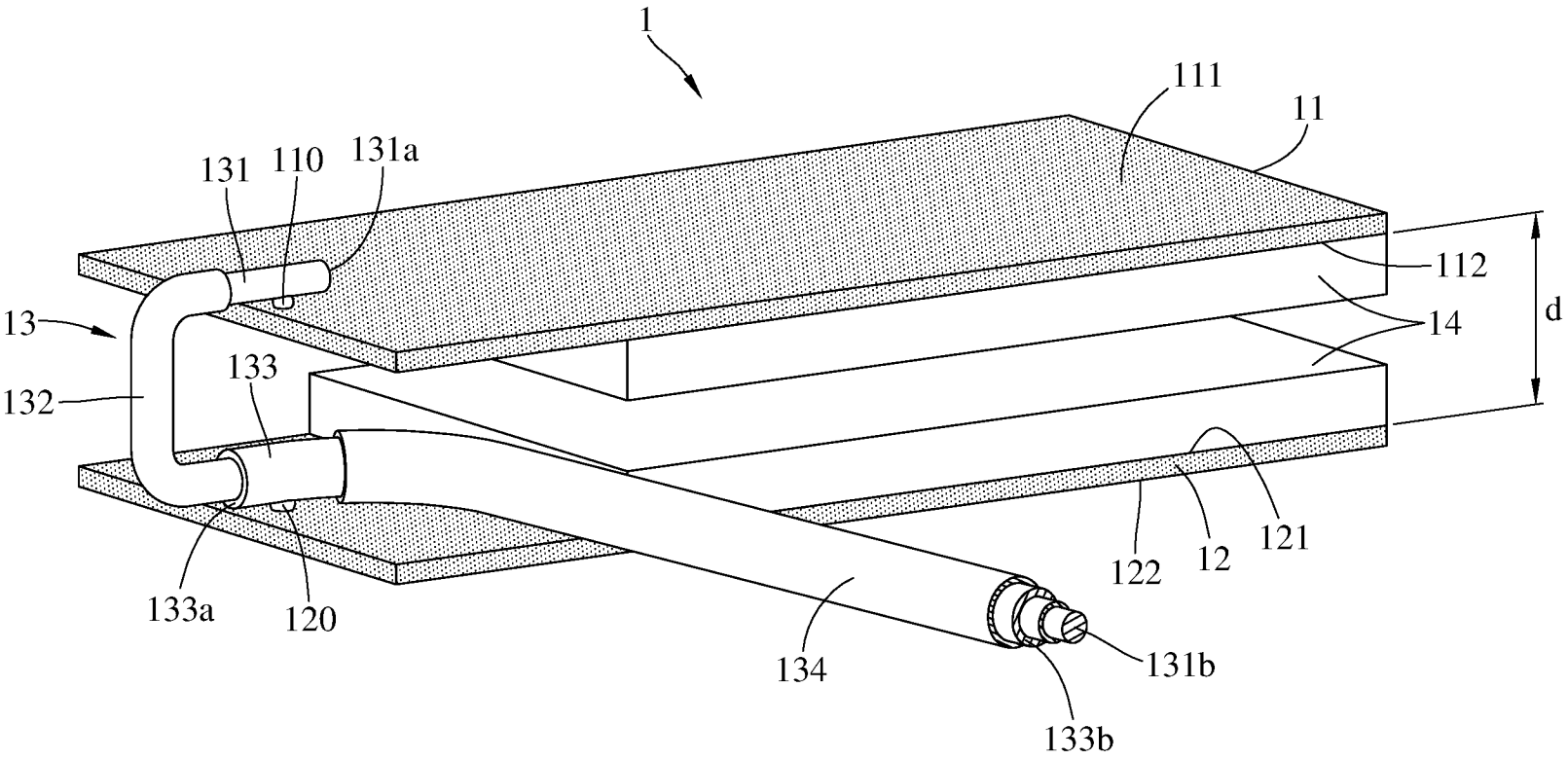
FIG. 1 is the structure diagram of the metal-interference-resisting dipole antenna in an embodiment based on this disclosure.

Please refer to FIG. 1, wherein FIG. 1 is the structure diagram of the metal-interference-resisting dipole antenna 1 in an embodiment based on this disclosure. As FIG. 1 shows, the dipole antenna 1 comprises a first metal plane 11, a second metal plane 12, a cable 13 and an antenna insulation layer 14. The first metal plane 11 and the second metal plane 12 may be the plane and be parallel to each other. Also, the first metal plane 11 and the second metal plane 12 are preferable to have identical shapes and sizes. On the other hand, the first metal plane 11 and the second metal plane 12 is able to keep being electrically insulated from each other through the antenna insulation layer 14, and be electrically connected to each other through the cable 13 connecting to an AC (alternating current) signal source (not shown in FIG. 1). Hence, through the antenna insulation layer 14, when the dipole antenna 1 is pressed by an external force, the first metal plane 11 and the second metal plane 12 won't be short circuit. Additionally, there's a distance d between the first metal plane 11 and the second metal plane 12, and the distance d is preferable to be between 4 mm to 5 mm in order to keep the dipole antenna 1 operating in a proper efficiency; however, this disclosure is not limited by it.

For descripting specifically about the first metal plane 11 and the second metal plane 12, please refer to FIG. 1. As FIG. 1 shows, the first metal plane 11 has a first upper surface 111 and a first lower surface 112, wherein the first upper surface 111 faces away from the first lower surface 112. Similar to the first metal plane 11, the second metal plane 12 has a second upper surface 121 and a second lower surface 122, wherein the second upper surface 121 faces to the first lower surface 112 of the first metal plane 11, and the second upper surface 121 is back to the second lower surface 122. In this embodiment, since the first lower surface 112 of the first metal plane 11 faces to the second upper surface 121 of the second metal plane 12, aforementioned antenna insulation layer 14 may be disposed on the first lower surface 112 and the second upper surface 121. Hence, when there's an external force forced on the dipole antenna 1, the first metal plane 11 and the second metal plane 12 are not touched each other for avoiding being short circuit. In addition, the antenna insulation layer 14 may be disposed on the first lower surface 112 of the first metal plane 11 only; alternatively, the antenna insulation layer 14 may be disposed on the second upper surface 121 of the second metal plane 12, and this disclosure is not limited by the configuration of the antenna insulation layer 14.

Figure 2:
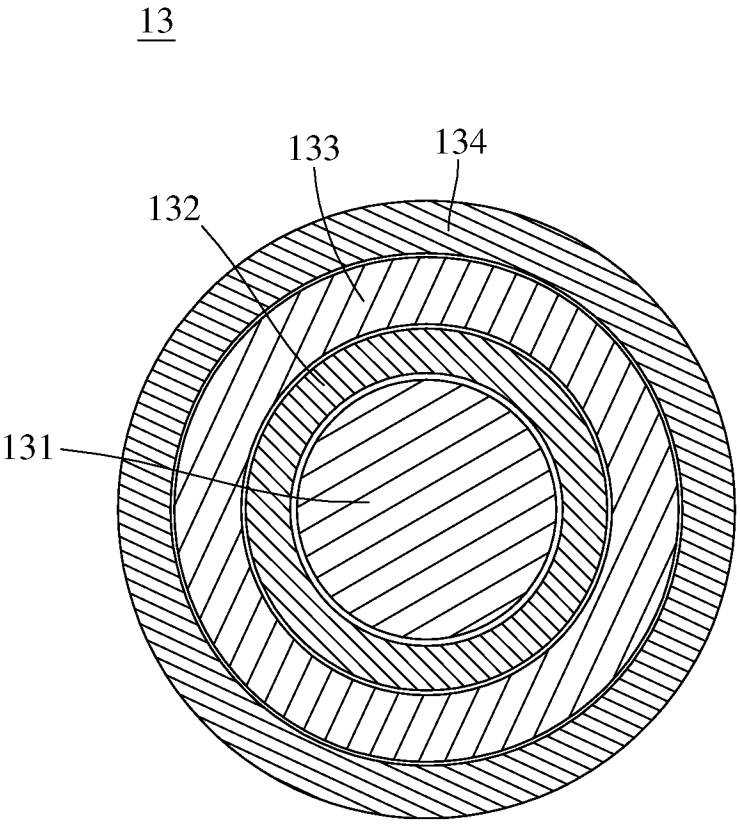
FIG. 2 is the sectional view of the cable of the metal-interference-resisting dipole antenna in an embodiment based on this disclosure.

For descripting specifically about the structure of the cable 13, please refer to FIG. 2. FIG. 2 is the sectional view of the cable 13 of the metal-interference-resisting dipole antenna 1 in an embodiment based on this disclosure. As FIG. 2 shows, the sectional view of the cable 13 is formed by a plurality of concentric circles. From the center to the periphery, the cable 13 sequentially includes an inner conductor 131, an insulator 132, an outer conductor 133 and a protective layer 134. Specifically, the inner conductor 131 and the outer conductor 133 are adapted for transmitting the signal with two opposite transmission direction. Also, the insulator 132 is able to make the inner conductor 131 and the outer conductor 133 being electrically insulated from each other, and the protective layer 134 is able to cover and protect the outer conductor 133 so as to make the outer conductor 133 being electrically insulated from other conductive properties. Particularly, corresponding to the inner conductor 131, the outer conductor 133 is disposed at the outer side of the insulator 132. That is, the inner conductor 131 is partly covered by the insulator 132, and the outer conductor 133 may be disposed as the way of covering the insulator 132; alternatively, the outer conductor 133 and the inner conductor 131 may be disposed as the way of two separate wires, and be electrically insulated from each other by the insulator 132. Additionally, the outer conductor 133 is partly covered by the protective layer 134 in order to protect the structure of the cable 13 and keep the conductivity of the cable 13.

For descripting specifically about the dipole antenna 1, please refer to FIG. 1 and FIG. 2 together. Aforementioned inner conductor 131 comprises a first inner connecting end 131*a* and a second inner connecting end 131*b*, wherein the inner conductor 131 of the cable 13 is partly exposed from the insulator 132 for forming the first inner connecting end 131*a*, and the first inner connecting end 131*a* is electrically connected to the first metal plane 11 in order to form the feed point 110 at the connection. In addition, the inner conductor 131 is covered by the insulator 132 between the first metal plane 11 and the second metal plane 12. Therefore, it may avoid the unexpected short circuit causing by the segments of the inner conductor 131 except for the first inner connecting end 131 contacting with the first metal plane 11, and it may also avoid the unexpected short circuit causing by the inner conductor 131 is contacted with the second metal plane 12. On the other hand, the second inner connecting end 131*b* of the inner conductor 131 is electrically connected to a AC signal source (not shown in the figures) so as to receive the first feed signal. Similarly, the outer conductor 133 has a first outer connecting end 133*a* and a second outer connecting end 133*b*, wherein the first outer connecting end 133*a* is between the first metal plane 11 and the second metal plane 12. Moreover, the insulator 132 protrudes from the first outer connecting end 133*a* of the outer conductor 133, and the insulator 132 extends to the first inner connecting end 131*a* of the inner conductor 131. Specifically, the outer conductor 133 is partly exposed from the protective layer 134 so as to from the first outer connecting end 133*a*, and the outer conductor 133 is electrically connected to aforementioned second upper surface 121 for forming another feed point 120 at the connection. Additionally, the outer conductor 133 is electrically connected to the AC signal source at the second outer connecting end 133*b* for receiving the second feed signal from the AC signal source, wherein the first feed signal and the second feed signal are the AC electric signals with opposite phase.

Figure 3:
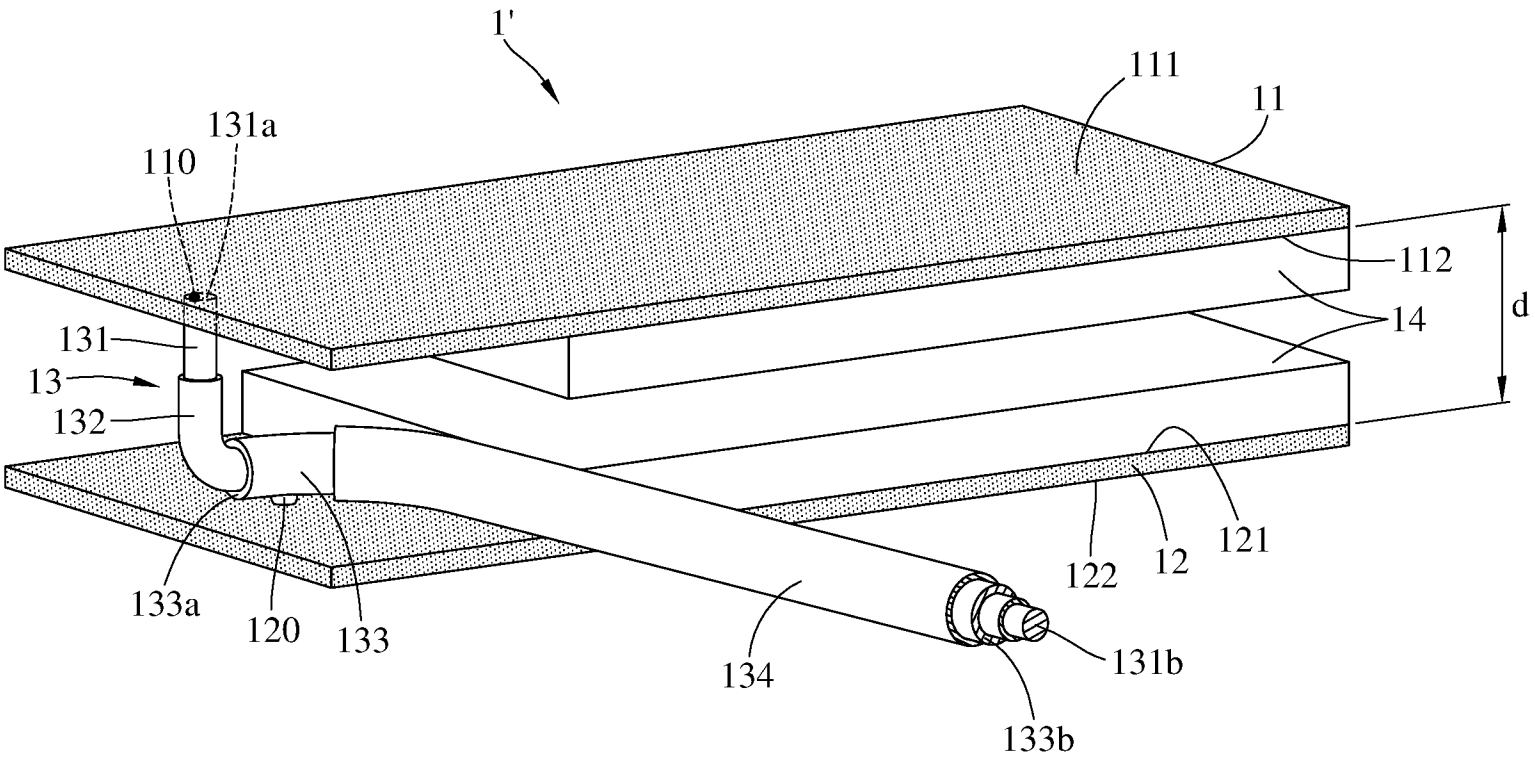
FIG. 3 is the structure diagram of the metal-interference-resisting dipole antenna in another embodiment based on this disclosure.

Please refer to FIG. 3, wherein FIG. 3 is the structure diagram of the metal-interference-resisting dipole antenna 1' in another embodiment based on this disclosure. The main difference between this embodiment and aforementioned embodiment is: the first inner connecting end 131*a* of the inner conductor 131 of the cable 13 electrically connected to the first lower surface 112 of the first metal plane 11, and a feed point 110 formed at the connection. In this embodiment, since the first inner connecting end 131*a* and the first outer connecting end 133*a* are both between the first metal plane 11 and the second metal plane 12, the first upper surface 111 and the second lower surface 122 both are flat planes. It is worth mentioning, the dipole antenna 1 as shown in FIG. 1, since the second lower surface 122 of the second metal plane 12 is not electrically connected to the cable 13 directly, the second lower surface 122 of the dipole antenna 1 is a flat plane. Therefore, comparison with the dipole antenna mentioned in the prior art, the area of the dipole antenna 1 and the dipole antenna 1' disclosed in this disclosure are reduced, and the dipole antenna 1 and the dipole antenna 1' further comprise the metal-interference-resisting function. On the other hand, since both of the dipole antenna 1 and the dipole antenna 1' have the flat planes facing to the outer side, the dipole antenna 1 and the dipole antenna 1' are able to be disposed and fixed directly at the inner side of the housing or other elements. As a result, the dipole antenna 1 and the dipole antenna 1' may be more flexible for configuration.

Figure 4:
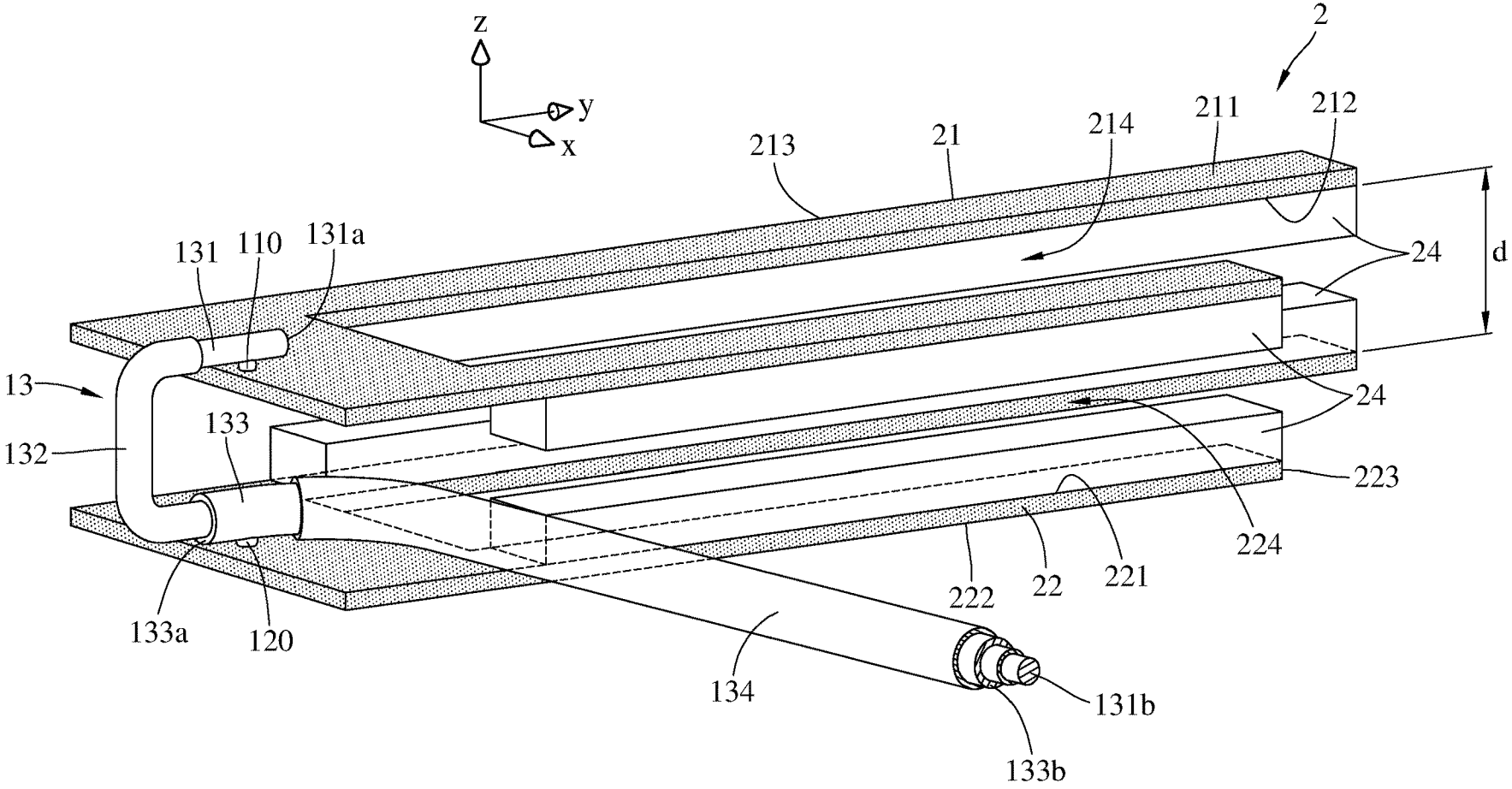
FIG. 4 is the structure diagram of the metal-interference-resisting dipole antenna in another embodiment based on this disclosure.

Please refer to FIG. 4, wherein FIG. 4 is the structure diagram of the metal-interference-resisting dipole antenna 2 in another embodiment based on this disclosure. As the dipole antenna 2 shown in FIG. 4, since the connection and the configuration between the first metal plane 21, the second metal plane 22, the cable 13 and the antenna insulation layer 24 are the same as the dipole antenna 1 shown in FIG. 1, and the position for forming the feed point 110 and feed point 120 are also the same as the dipole antenna 1 shown in FIG. 1, the detailed description is not illustrated again. Comparison this embodiment with the embodiment in FIG. 1, the main difference is the first side circumference 213 having a first recess portion 214 forming a first opening. In addition, the first side circumference 213 is a part of the first metal plane 21, and the first side circumference 213 is connected the first upper surface 211 to the first lower surface 212. Similarly, the second side circumference 223 has a second recess portion 224, and there's a second opening formed by the second recess portion 224, wherein the first opening and the second opening are faced to the same direction. Specifically, as FIG. 4 shows, both of the first opening and the second opening are faced to the positive y-axis direction. In addition, the second recess portion 224 is a part of the second metal plane 22, and the second recess portion 224 is connected the second upper surface 221 to the second lower surface 222. Since the dipole antenna 2 comprises the first recess portion 214 and the second recess portion 224, without the interference in the operation of the dipole antenna 2, other elements are able to be disposed in the inner side of the first recess portion 214 and the second recess portion 224 based on the applications in practice, and the space inside the electronic device is able to be used efficiently and flexibly.

As the detailed descriptions illustrated above, this disclosure provides a metal-interference-resisting dipole antenna. The dipole antenna in this disclosure is made by folding the typical dipole antenna, so the occupied space of the dipole antenna disposed in the electronic device may be reduced, and the operation of the dipole antenna may not be effected obviously when there's an object contained the metal materials closed to it. The dipole antenna in this disclosure not only comprises the unexpected result, but also improves the problem of the space configuration in the electronic device or other devices.

The embodiments depicted above and the appended drawings are exemplary and are not intended to be exhaustive or to limit the scope of the present disclosure to the precise forms disclosed. Many modifications and variations are possible in view of the above teachings.

What is claimed is:

1. A metal-interference-resisting dipole antenna, including:

a first metal plane;

a second metal plane; and a cable including an inner conductor, an insulator and an outer conductor, wherein the inner conductor has a first inner connecting end and a second inner connecting end, the first inner connecting end is electrically connected to the first metal plane, the second inner connecting end is adapted for receiving a first feed signal, the inner conductor is partially covered by the insulator, the outer conductor is, corresponding to the inner conductor, disposed on an outer side of the insulator, and the outer conductor is electrically insulated from the inner conductor, and wherein the outer conductor has a first outer connecting end and a second outer connecting end, the first outer connecting end is electrically connected to the second metal plane, and the second outer connecting end is adapted for receiving a second feed signal;

wherein the second metal plane has a surface facing the first metal plane, and the first outer connecting end is electrically connected to the surface of the second metal plane; wherein the first metal plane comprises a first upper surface, a first lower surface and a first side circumference, the first side circumference connects the first upper surface to the first lower surface, and the first metal plane has a first recess portion forming a first opening at the first side circumference; wherein the surface of the second metal plane is a second upper surface, the second metal plane further comprises a second lower surface and a second side circumference, the second lower surface is back to the second upper surface, the second side circumference connects the second upper surface to the second lower surface, and the second metal plane further has a second recess portion forming a second opening at the second side circumference; and wherein the first opening and the second opening face in the same direction.

2. According to the dipole antenna of claim 1, wherein the first upper surface of the first metal plane faces away from the surface of the second metal plane, and the first inner connecting end is electrically connected to the first upper surface of the first metal plane.

3. According to the dipole antenna of claim 1, wherein the first upper surface of the first metal plane faces the surface of the second metal plane, and the first inner connecting end is electrically connected to the first lower surface of the first metal plane.

4. According to the dipole antenna of claim 1, wherein the first metal plane and the second metal plane are in flat plane shapes, and parallel to each other, and have identical shapes and sizes.

5. According to the dipole antenna of claim 1, wherein there is an antenna insulation layer between the first metal plane and the second metal plane, and the antenna insulation layer electrically insulates the first metal plane from the second metal plane.

6. According to the dipole antenna of claim 1, wherein a distance between the first metal plane and the second metal plane is from 4 mm to 5 mm.

7. According to the dipole antenna of claim 1, wherein the insulator protrudes from the first outer connecting end of the outer conductor and extends to the first inner connecting end of the inner conductor.

* * * * *